US005392938A

United States Patent [19]

Dubach

[11] Patent Number: 5,392,938

[45] Date of Patent: Feb. 28, 1995

[54] SNAP HINGE CLOSURE WITH SECURITY RING

[75] Inventor: Werner F. Dubach, Maur, Switzerland

[73] Assignee: Createchnic Ag, Switzerland

[21] Appl. No.: 971,965

[22] PCT Filed: Jun. 11, 1992

[86] PCT No.: PCT/CH92/00113

§ 371 Date: Feb. 18, 1993

§ 102(e) Date: Feb. 18, 1993

[87] PCT Pub. No.: WO93/00271

PCT Pub. Date: Jul. 1, 1993

[30] Foreign Application Priority Data

Jun. 21, 1991 [CH] Switzerland ..... 1842/91

[51] Int. Cl.[6] ..... B65D 51/18

[52] U.S. Cl. ..... 215/254; 215/235; 215/237; 220/254; 220/266; 220/339; 222/556

[58] Field of Search ..... 215/254, 235, 237, 238, 215/256, 258; 220/254, 266, 276, 339, 337; 222/546, 556

[56] References Cited

U.S. PATENT DOCUMENTS 4,482,070 11/1984 Dubach .
4,487,324 12/1984 Ostrowsky .
4,519,517 5/1985 Walter .
4,696,408 9/1987 Dubach .
4,717,033 1/1988 Dubach .
4,782,964 11/1988 Poore et al. ..... 215/216
4,921,113 5/1990 Dubach .
5,069,367 12/1991 Salmon et al. ..... 222/153
5,083,671 1/1992 Hayes ..... 215/245
5,094,361 3/1992 Dubach ..... 222/81
5,096,077 3/1992 Odet et al. ..... 215/211
5,141,138 8/1992 Odet et al. ..... 222/541

FOREIGN PATENT DOCUMENTS 0296100 12/1988 European Pat. Off. .
0381516 8/1990 European Pat. Off. .
675410 9/1990 Germany .
9014286 11/1990 WIPO .

*Primary Examiner*—Allan N. Shoap
*Assistant Examiner*—Vanessa Caretto
*Attorney, Agent, or Firm*—Speckman, Pauley & Fejer

[57] ABSTRACT

A one-piece snap hinge closure of plastic having a lower part and an upper part connected with each other via a film hinge. The intactness of the closure is assured by a security band. The security band is injection-molded to the upper part via bars which are used as predetermined breaking points. A bar on the lower part is engaged with the security band. The bar on the lower part can be placed in such a way that in the security position of the closure it is attached behind a tab on the upper part.

9 Claims, 2 Drawing Sheets

SNAP HINGE CLOSURE WITH SECURITY RING

BACKGROUND OF THE INVENTION

1. Field of the Invention

This invention relates to a one-piece snap hinge closure of plastic, including a lower part and an upper part, or cap, connected with it via a film hinge, which has a security ring or security band injection-molded in one piece to a closure part, as well as at least one recess which is engaged by a respectively protruding bar on the other closure part, so that the two closure parts are locked together in a form-fitting manner prior to removal of the security band.

2. Description of the Prior Art

Plastic closures with security bands have been known for some time. This applies in particular to plastic screw closures for bottles having a screw cap with a security band injection-molded in one piece to it which extends at least approximately completely around the closure. Security bands on snap hinge closures are much less known. This is especially due to the considerably more complicated geometry. Snap hinge closures are for the most part injection-molded in a completely open state and are closed afterwards. In this case it is necessary to bring parts protruding from one closure part into engagement with recesses on the other closure part or on the security band. This requires a high degree of flexibility of the security band, so that the protruding parts which are used as locks and the predetermined breaking points, by which the security band is connected with the closure, are not destroyed during the closing operation.

A snap hinge closure of the above mentioned type with a security band is known from U.S. Pat. No. 4,487,324, for example. To reduce as much as possible the danger of destroying the connection between the security band and the closure, the security band is kept as small as possible and the distance between the individual predetermined breaking points is relatively great. Unfortunately, it has been shown that with relatively little skill it is possible to open this type of snap hinge closure without destroying the security band. One of the reasons for this is that the locking mechanism is clearly visible.

In contrast thereto, U.S. Pat. No. 4,696,408 discloses a snap hinge closure of plastic with a security band extending around half of the circumference of the closure. Here, the security band is injection-molded to the lower part of the closure via appropriate bars and extends far upwards, so that the cap, or the upper closure part, cannot be grasped in the security position of the closure. In a certain embodiment, there is a recess provided in the security band which is engaged by a bar on the upper part of the closure in the security position. However, this only represents an additional lock, the actual securing, however, is associated with arranging the security band around the cap of the closure in such a way that it cannot be grasped in the area opposite the hinge and therefore cannot be opened.

This type of plastic snap hinge closure has proven particularly successful with bottles. However, this type of snap hinge closure with a security band is not suitable for smaller closures, for example for tubes, because the cap is too small for housing an additional user-friendly grasping recess for opening. If the grasping recess is too small, it is necessary to attach a tab for opening. But in this case the tab extends outward to such a degree that it can no longer be covered by the security band, or that in the closing operation it cannot be guided behind the band without destroying the connection of the security band with the lower closure part.

SUMMARY OF THE INVENTION

It is one object of this invention to provide a snap hinge closure of the previously mentioned type, which can be closed with little danger of destruction, which is suited for use with small closures, in particular for use with tubes, and which permits the provision of a large tab on the upper closure part.

The above object is attained by a snap hinge closure with a security band that is injection-molded to an upper closure part so that in a security position the security band at least partially covers the outer jacket wall of a lower closure part. A bar, which is engaged with the security band in the security position, is injection-molded to the lower closure part.

Further advantageous embodiments of this invention will be explained in the following description in view of the attached drawings.

DESCRIPTION OF PREFERRED EMBODIMENTS

Figure 1:
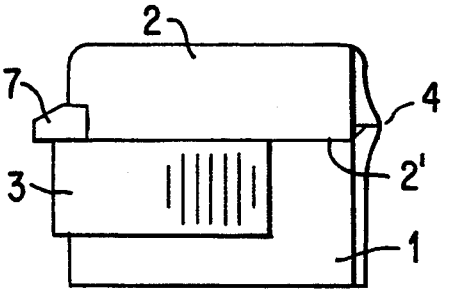
FIG. 1 is a side view of a snap hinge closure in a security position according to one preferred embodiment of this invention.
Figure 2:
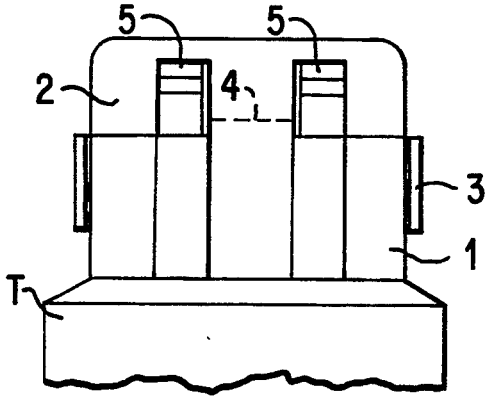
FIG. 2 is the same closure as shown in FIG. 1, in an assembled state in the security position on a tube.
Figure 3:
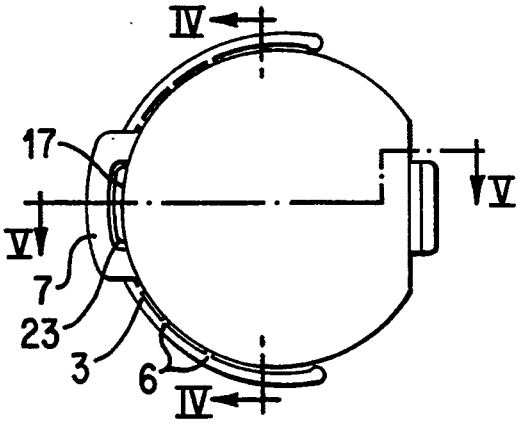
FIG. 3 is a top view of the closure shown in FIGS. 1 and 2.
Figure 4:
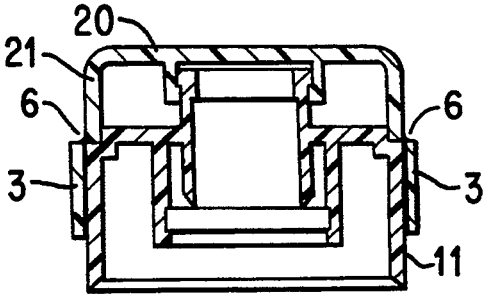
FIG. 4 is a vertical sectional view taken through the closure of FIG. 3 along the line IV—IV.
Figure 5:
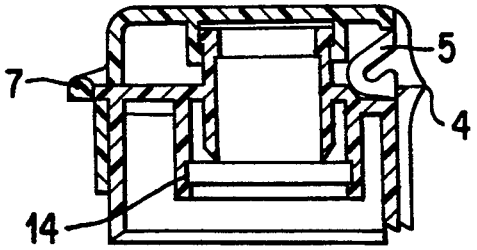
FIG. 5 is another vertical sectional view taken through the same closure of FIG. 3 along the line V—V.
Figure 7:
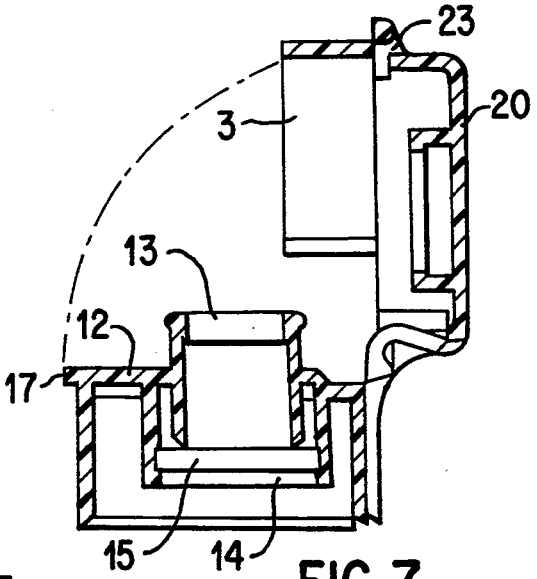
FIG. 7 is a vertical sectional view of the closure of FIG. 6 but in an intermediate state prior to the first closing.
Figure 6:
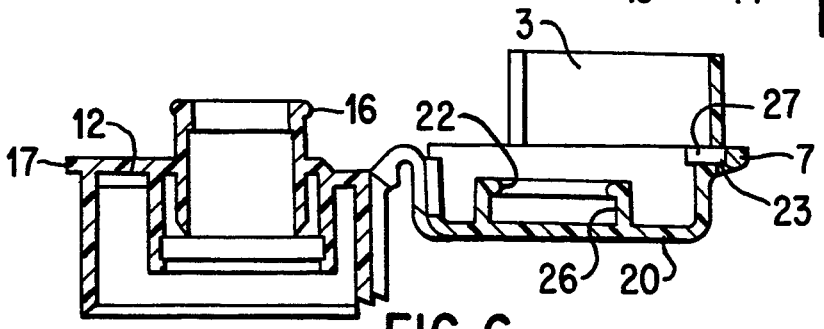
FIG. 6 is a vertical sectional view taken through the closure in a manufacturing state.

A plastic closure according to this invention is shown in a security position in FIGS. 1 and 3, in which the plastic is mounted on container to be closed. In FIG. 2, the same closure is shown mounted on a tube. As is customary, the closure comprises a lower part 1 used for attachment to a container or a tube T, and an upper part 2 which is embodied as a cap. The lower part 1 and the upper part 2 are connected with each other in one piece via a film hinge 4. A security band 3 is injection-molded via bars 6 to the lower edge 2' of the upper part 2. The bars 6 form predetermined breaking points, which are destroyed when the security band 3 is removed. The snap effect of the plastic closure is caused in the illustrated embodiment by two spring elements 5, which approximately adjoin the film hinge 4 forming the main hinge axis. Each spring element 5 is in the form of a U-shaped, extendable spring, one end of which is fixedly connected via a first hinge point with the upper part and via a second hinge point with the lower part. A tab 7 is formed on the upper part 2 for operating the closure. The tab 7 has the form of a U-shaped hoop extending past the circumference of the security band 3. The tab 7 is positioned on the upper part 2 directly above the security band 3. The security band 3 extends over approximately one-half of the circumference of the closure. A greater length of the security band 3 than that shown in FIGS. 1 to 3 would be difficult to lock into the security position shown without destroying the most outwardly located bars 6.

The lower part 1 comprises an outer annular jacket wall 11 closed off by a cover surface 12. An outlet nozzle 13 extends through the cover surface 12. The outlet nozzle 13 communicates with the container neck on which the closure is placed. The annular wall 14, which extends concentrically around the outlet nozzle 13, is used to support the closure on the container neck mentioned. This is accomplished by means of a positive lock, which is formed by means of a support groove 15 on the inside surface of the annular wall 14. The actual seal between the lower part 1 and the upper part 2 is formed by an annular collar 16 on the upper edge of the outlet nozzle 13. The upper part, or the cap 2, also has an annular jacket wall 21 which, in the closed position of the closure, lies vertically aligned atop the jacket wall 21. The jacket wall 21 of the cap 2 is closed by a cover surface 20. A sealing annular wall 26 is formed on the inner surface of the cover surface 20 and is exactly aligned with the outlet nozzle 13 in the lower part 1. An annular collar 22 is applied to the inner surface of the sealing annular wall 26 which, in cooperation with the annular collar 16 on the nozzle 13, results in a seal.

Figure 8:
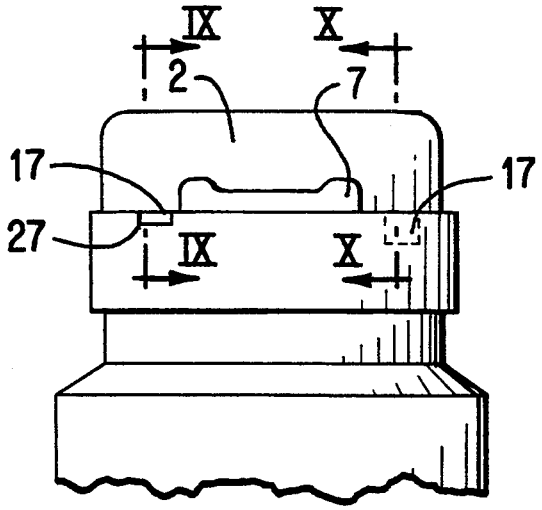
FIG. 8 is a front view of a plastic closure according to this invention in a security position, having two different locking mechanisms.
Figure 9:
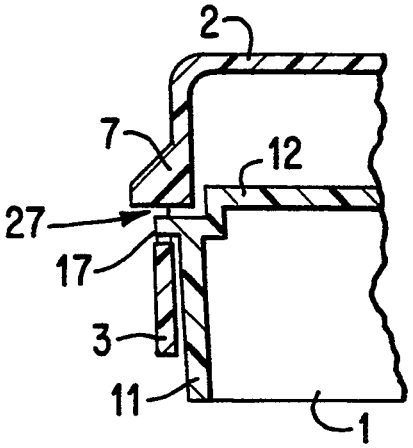
FIG. 9 is a partial sectional view of a closure cap according to one preferred embodiment of this invention.

The security position of the closure is assured since an element on the lower part 1 of the closure is in engagement with a recess 27 in the security band 3. This can be accomplished in various ways. In the embodiment in accordance with FIGS. 1 to 7 this is accomplished by means of a bar 17, which is shaped as an extension in alignment with the cover surface 12 and which can be brought into engagement with a recess 27 disposed in the area of a free space 23 of the tab 7. The tab 7 itself has the form of a U-shaped hoop as shown in FIG. 3. The advantage of such an embodiment lies mainly in that in the security position of the closure the locking is not visible at all. In contrast to this, the variant of the locking as shown in FIGS. 8 and 9, is visible. Here, the bar 17 is no longer connected in alignment with the cover surface 12 of the lower part 1, but is injection-molded so that it is displaced slightly lower with respect to its surface. Thus, the recess 27 is no longer flush with the upper edge of the security band 3.

Figure 10:
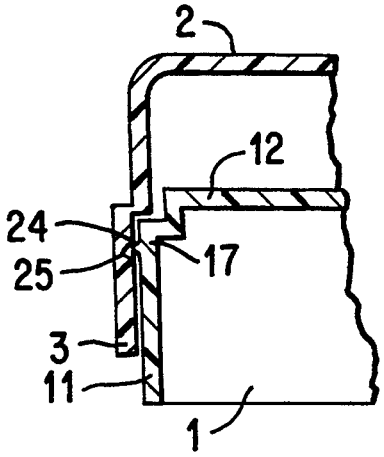
FIG. 10 is a partial sectional view of a closure cap according to another preferred embodiment of this invention.

The preferred embodiment of this invention in accordance with FIGS. 8 and 10 again shows covered locking. This is accomplished by means of a recess 24 in the security band 3, which has the function of a recess 27 and has a lower locking edge 25. The bar 17 at the jacket wall 11 has a complementary shape to that of the recess 24.

The advantage of all the described preferred embodiments that it is possible to assure faultless operation regardless of the relatively small size of the closure. Even when the closure is very small and therefore an appropriately large tab 7 must be installed, the tab 7 does not get in the way. The disposition of the security band 3 on the upper part, or cap 2, thus gives the designer much more freedom in the aesthetic design of the closure and increases the ease of operation.

I claim:

1. In a one-piece plastic snap hinge closure having a lower closure part (1) with a jacket wall (11) and an upper closure part (2) connected to the lower closure part (1) with a film hinge (4), wherein a security band (3) is injection-molded in one piece to the closure, the security band (3) having at least one recess (27) which is respectively engaged by a protruding bar (17) of the closure, so that the lower closure part (1) and the upper closure part (2) are locked together in a form-fitting manner, the improvement comprising: the security band (3) being injection-molded to the upper closure part (2) so that in a security position the security band (3) at least partially covers the jacket wall (11) of the lower closure part (1), the protruding bar (17) which is in engagement with the security band (3) in the security position being injection-molded to the lower closure part (1), the upper closure part (2) having a tab (7) which extends beyond an outer surface of the security band (3), and the tab (7) having a form of a U-shaped hoop forming a free space (23), between an outer wall (21) of the upper closure part (2) and an inner tab surface of the tab (7), of which the protruding bar (17) rests in the security position.

2. A snap hinge closure in accordance with claim 1, wherein the security band (3) extends at least approximately over one-half of an entire circumference of the one-piece plastic snap hinge closure.

3. A snap hinge closure in accordance with claim 1, wherein an inner band surface of the security band (3) forms a recess (24) with a locking edge (25), which is engaged by the protruding bar (17) in the security position.

4. A snap hinge closure in accordance with claim 1, wherein the security band (3) forms an opening which is of a size accommodating the protruding bar (17).

5. In a one-piece plastic snap hinge closure having a lower closure part (1) with a jacket wall (11) and an upper closure part (2) connected to the lower closure part (1) with a film hinge (4), wherein a security band (3) is injection-molded in one piece to the closure, the security band (3) having at least one recess which is respectively engaged by a protruding bar (17) of the closure, so that the lower closure part (1) and the upper closure part (2) are locked together in a formfitting manner, the improvement comprising: the security band (3) being injection-molded to the upper closure part (2) so that in a security position the security band (3) at least partially covers the jacket wall (11) of the lower closure part (1), the protruding bar (17) which is in engagement with the security band (3) in the security position being injection-molded to the lower closure part (1), and in the security position the protruding bar (17) rests on an upper edge of the security band (3).

6. In a one-piece plastic snap hinge closure having a lower closure part (1) and an upper closure part (2) connected to the lower closure part (1) with a film hinge (4), a security band (3) injection-molded in one piece to the closure, the security band (3) having at least one recess (27) which is respectively engaged by a protruding bar (17) of the closure, so that in a security position of the closure the lower closure part (1) and the upper closure part (2) are interlocked, the improvement comprising: the security band (3) extending over at least approximately one-half an entire circumference of the upper closure part (2), the security band (3) forming a plurality of breaking point areas with a lower edge of the upper closure part (2), and the protruding bar (17) which is in engagement with the security band (3) in the security position being formed onto the lower closure part (1) in a wall area of the lower closure part (1) about which the security band (3) is positioned, the upper closure part (2) having a tab (7) which projects beyond an outer surface of the security band (3), and the tab (7) having a form of a U-shaped hoop forming a free space (23) between an outer wall (21) of the upper closure part (2) and an inner tab surface of the tab (7) within which the protruding bar (17) rests in the security position.

7. A snap hinge closure in accordance with claim 6, wherein in a closed position of the closure peripheral walls of the lower closure part (1) and the upper closure part (2) are aligned.

8. A snap hinge closure in accordance with claim 6, wherein the security band (3) has at least one recess (24) with a locking edge (25) which is engaged by the protruding bar (17) in the security position.

9. A snap hinge closure in accordance with claim 6, wherein the at least one recess (27) is at least approximately of a size that accommodates the protruding bar (17) in the security position.

* * * * *